US005270735A

United States Patent [19]

Fiscella et al.

[11] Patent Number: 5,270,735

[45] Date of Patent: Dec. 14, 1993

[54] PRINTER DRIVE

[75] Inventors: Marcello D. Fiscella, Fairport; James E. Pickering, Holcomb, both of N.Y.

[73] Assignee: Eastman Kodak Company, Rochester, N.Y.

[21] Appl. No.: 960,651

[22] Filed: Oct. 14, 1992

Related U.S. Application Data

[63] Continuation-in-part of Ser. No. 772,313, Oct. 7, 1991, abandoned.

[51] Int. Cl.[5] ..... B41J 2/32

[52] U.S. Cl. ..... 346/76 PH; 346/134; 346/136; 400/636

[58] Field of Search ..... 400/634, 636, 637, 639; 746/134; 346/136, 76 PH

[56] References Cited

U.S. PATENT DOCUMENTS 4,532,525 7/1985 Takahashi ..... 346/76 PH
4,720,714 1/1988 Yukio ..... 346/134

FOREIGN PATENT DOCUMENTS 56-25480 3/1981 Japan .
60-38181 2/1985 Japan .
61-179758 8/1986 Japan .
62-218165 9/1987 Japan .

OTHER PUBLICATIONS

T. C. Soony and C. Li, "The Rolling Contract of Two Elastic-Layer-Covered Cylinders Driving A Loaded Sheet in a Nip", *The Journal of Applied Mechanics*, Dec., 1981, vol. 48/889.

*Primary Examiner*—Benjamin R. Fuller
*Assistant Examiner*—Huan Tran
*Attorney, Agent, or Firm*—William W. Holloway

[57] ABSTRACT

A thermal printer is disclosed in which a receiver is driven back and forth relative to a printing head by a driving roller. The receiver is driven at a nip formed between the driving roller and a pinch roller. The pinch roller is adapted to contact only the receiver during the movement of the receiver. The receiver is thereby permitted to move at the surface speed of the driving roller with reduced shear forces being introduced by the pinch roller. Consequently, a pinch roller with a high length to diameter ratio is usable and images can be produced on wide receivers with narrow image-free borders. The images are produced with precise registration and image artifacts are reduced.

7 Claims, 3 Drawing Sheets

PRINTER DRIVE

CROSS REFERENCE TO RELATED PATENT APPLICATIONS

The present application is a Continuation-in-Part of U.S. patent application Ser. No. 772,313, entitled "Improved Printer Driver", filed Oct. 7, 1991, now abandoned, which has common inventorship, and has a common assignee with the present patent application.

FIELD OF THE INVENTION

The present invention relates to the field of printing, and more particularly, to the field of thermal printing of multi-color images.

BACKGROUND OF THE INVENTION

In certain types of thermal printers, a receiver of print medium, such as paper, and a dye-donor film is moved past a print head as the print head causes an image to be transferred to the receiver. The receiver is moved past the print head in a series of repetitive passes. Each pass is made using a different color dye-donor film. In this manner, a series of overlying colored images are generated on the receiver. When the overlying images are properly registered with one another, the resultant image on the receiver is a full color image.

Registration of the overlying images is critically important to the quality of the final image. If one of the overlying images is not properly registered to the other images, then any one of a number of image artifacts occurs. One common artifact is known as a "halo effect". A halo effect of three primary colors appears around text that is printed in black when overlying images are misregistered.

Various techniques have been used in the prior art to assure accurate registration of overlying images. For example, some prior art thermal printers use clamps to positively lock a receiver on a drum. The drum is rotated to move the receiver past the print head for a first color image. The drum is then reversed and rotated to a starting position to re-align a leading edge of the receiver with the print head. The drum is then rotated again in a forward direction to move the receiver past the print head to produce a second color image. This process is repeated until a full color image is present on the receiver.

A printer which operates with a positively clamped receiver has the disadvantage of being slow to operate and requiring complex hardware. Additionally, such a printer requires a drum circumference which is equal to or larger than the length of a receiver. These are disadvantages which make such a printer undesirable for applications in typical office settings where low cost, compact size and high speed of operation are important considerations.

For typical office applications, thermal printers have been adapted to employ simpler and less expensive receiver driving systems. One such system is known as a nip driving system. A nip driving system uses a driving roller and a pinch roller to move a receiver past a print head. A receiver is driven by a nip that is formed at an interface of the pinch roller and the driving roller. As the driving roller is rotated in a forward direction, the receiver is moved past the print head to form a first color image. The driving roller is then reversed and the receiver is moved backward so that its leading edge is aligned with the print head. The driving roller is then rotated in the forward direction as a second color image is formed on the receiver. This process is repeated until all of the desired colors are printed on the receiver.

Prior art nip driven thermal printers are simpler and faster than clamping drum thermal printers, but they suffer from the disadvantage that the receiver does not always move the same distance for a given angular displacement of the driving roller. It has been found that, for example, that a forward 300 degree rotation may produce a 3.001 inch displacement of the receiver while a backward 300 degree rotation produces a 3.002 inch displacement of the receiver. We have found that these displacement variations are produced by variations in shear force that are generated between the rollers that create the nip and the receiver which is driven in the nip. A mathematical analysis of a related phenomenon is discussed in substantial detail in an article by T. C. Soong and C. Li in *The Journal of Applied Mechanics*, entitled "The Rolling Contact of Two Elastic-Layer-Covered Cylinders Driving a Loaded Sheet in the Nip", December 1981, Vol. 48/889.

In the prior art, these shear force variations were not recognized as factors which contributed to diminishment of image quality. There was a recognition that slippage of a receiver was a problem to be avoided, but the efforts to avoid slippage were not directed to elimination of shear force variations. Typically, prior art printers employed brute force mechanics in attempts to control receiver slippage. For example, thermal printers and plotters are disclosed in U.S. Pat. No. 4,532,525 (Takahashi), issued Jul. 30, 1985, U.S. Pat. No. 4,720,714 (Yukio), issued Jan. 19, 1988 and Japanese Patent No. 60-38181 (Amakawa), issued Feb. 27, 1985, which employ driving rollers with textured surfaces. These textured surfaces are designed to interlock with a surface of a receiver and thus avoid slippage. Another thermal printer disclosed in Japanese Patent No. 62-218165 (Oide), issued Sep. 25, 1987, uses multiple back-up rollers bearing against a receiver and a driving roller in an attempt to control slippage. Still another thermal printer is disclosed in Japanese Patent No. 61-179958 (Kataobe), issued Dec. 8, 1986, which employs a movable printing head synchronized with a paper driving system to overcome problems related to paper positioning. All of these prior art thermal printers employ complex mechanics in an effort to overcome variations in shear force which produce slippage. None of these prior art printers employ any techniques that avoid an introduction of these variation of shear forces.

In spite of these shortcomings, nip driving systems are still the driving system of choice for thermal printers intended for use in office settings. In these office applications, a color thermal printer is typically used with a personal computer as a substitute or an adjunct to a laser printer. In this context, it is very important that the color thermal printer has a low price. Because of the relative simplicity of nip driven color thermal printers, they can be manufactured at a low cost and sold at a relatively low price.

However, full acceptance of color thermal printers in office settings has not occurred in spite of the availability of inexpensive machines. This is because prior art nip-driven, color thermal printers are not capable of producing desirable images on standard or typical office paper. The typical paper used in offices today is about eight inches wide and eleven inches long. When a user of a personal computer in an office wants to make a paper output of a computer generated image, the user typically expects to use conventional office paper for the image, i.e., 8 inch wide paper. Additionally, the user expects to be able to get an image that covers substantially the entire sheet of paper. In other words, there is an expectation that any image-free borders on the paper will be relatively small.

These expectations have heretofore presented insoluble design dilemmas for producers of color thermal printers. In order to maintain decent image quality, the nip rollers of the prior-art color thermal printers were built with high mechanical strength. To be assured of low slippage, it was considered imperative that the rollers should not bend along their axes. A typical roller in a prior art, nip-driven color thermal printer has a length that is no more than three times its diameter. In such a printer, the image cannot be produced on a wide sheet of paper with a narrow image-free border. For example, it is not possible to produce an image with a one inch image-free border on typical eight inch wide office paper with a prior art nip-driven color thermal printer. Such an image requires a use of nip rollers with a radius smaller than one inch and a length about the same as the eight inch width of the paper. Such a roller would not have the requisite stiffness or resistance to bending that is required in prior art color thermal printer designs.

There are printers disclosed in the aforementioned Yukio and Kataobe patents which use rollers that appear to have a length greater than three times their diameters. However, these printers are not used to produce color images with a thermal technique, i.e., superimposed images generated on a receiver in a series of repetitive passes of the receiver across a thermal printhead. Instead the Yukio and Kataobe printers are used to produce monochromatic images with only a single pass of a receiver across a printhead.

We have found that the failure to attain highly accurate image registration in a nip driven color thermal printer is related to the nature of the prior art nip driving systems. In the prior art, the driving roller and the pinch roller are allowed to contact each other as the receiver is driven. We have found that this permits a differential shear force to develop in the receiver as the receiver is moved. These shear forces cause random variations in the surface speed of the receiver relative to the surface speed of the driving roller. Prior art printers require very rigid rollers to maintain a low rate of slippage. Thus the prior art nip driven color thermal printers have an inherent limitation on the size of an image that can be produced on a wide sheet of paper.

It is desirable therefore to provide a color thermal printer that operates at high speeds, has a low cost, and produces high resolution color image with accurate image registration. It is particularly desirable to provide such a color thermal printer which is capable of producing images with narrow image-free borders on relatively wide paper.

SUMMARY OF THE INVENTION

The present invention is directed to a color thermal printer in which a receiver is driven back and forth relative to a printing head by a driving roller. The receiver is driven at a nip formed between the driving roller and a pinch roller. The pinch roller is adapted to contact only the receiver during the movement of the receiver. The receiver is thereby permitted to move at the surface speed of the driving roller with relatively low shear forces being introduced by the pinch roller. The driving roller has a relatively high length to diameter ratio. Consequently, overlying images with precise registration can be produced on wide receivers with narrow image-free borders.

Viewed from one aspect, the present invention is directed to a color thermal printer comprising a driving roller for driving a receiver past a print head and a pinch roller adapted to exert force against the driving roller along a nip. The pinch roller has a length along its axis that is no longer than a width of the receiver being driven by the driving roller. The pinch roller has a length to diameter ratio of about four times or greater.

Viewed from another aspect, the present invention is directed to a method of printing which comprises the steps of driving a receiver past a printing head while producing a first color image thereon, withdrawing the receiver from the printing head, and driving the receiver past the printing head while producing a second color image thereon. The driving and withdrawing steps are performed by rotating a driving roller that is frictionally engaged with the receiver. A frictional force is maintained between the receiver and the driving roller with a pinch roller that contacts the receiver but does not contact the driving roller.

The invention will be better understood from the following detailed description taken in consideration with the accompanying drawings and claims.

The drawings are not necessarily to scale.

DETAILED DESCRIPTION

Figure 1:
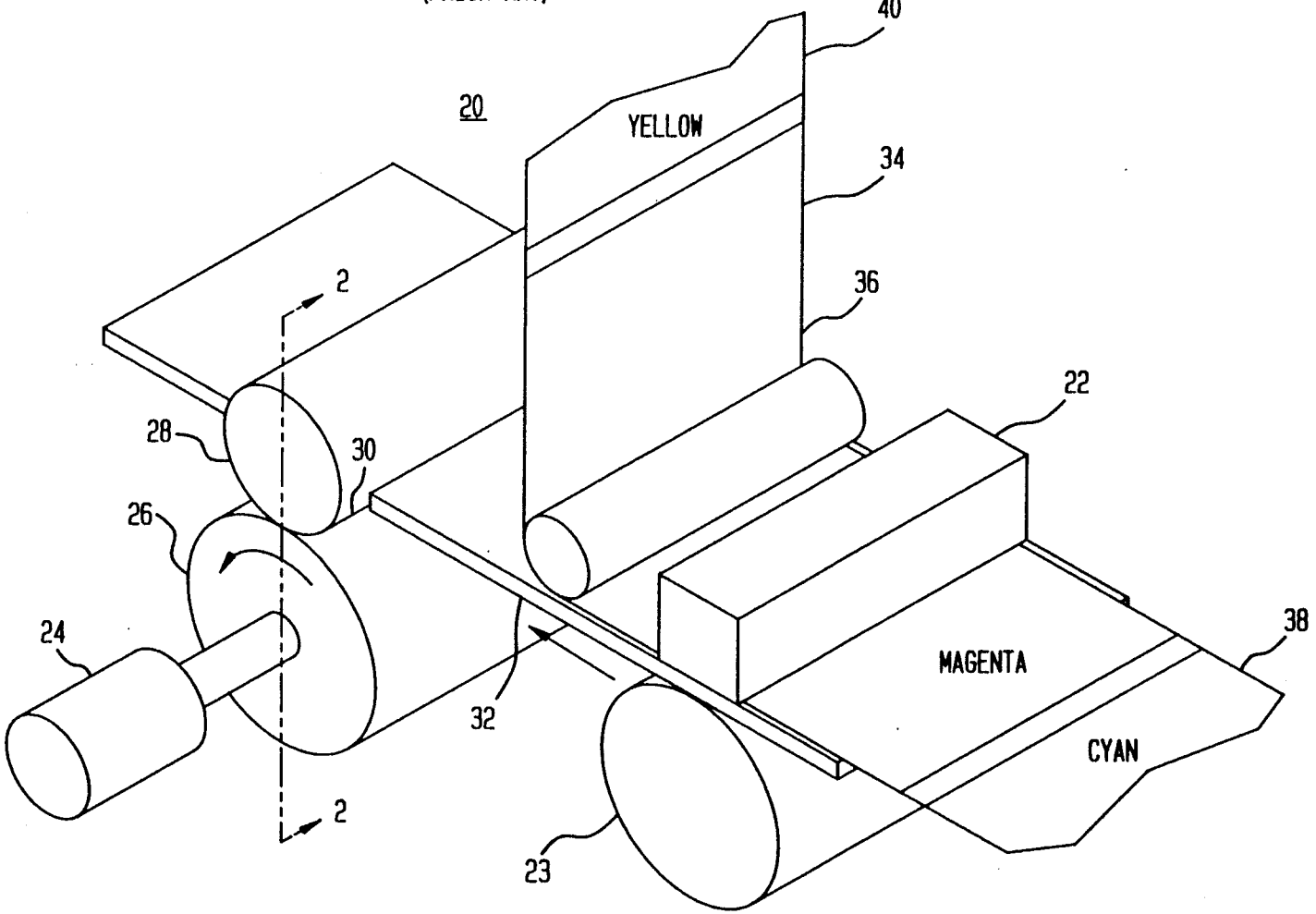
FIG. 1 (PRIOR ART)
FIG. 1 is a perspective schematic view of a thermal printer in accordance with the prior art.

Referring now to FIG. 1, there is shown schematically a thermal printer 20 in accordance with the prior art. The prior art printer 20 comprises a print head 22, a print platen 23, a drive motor 24, a driving roller 26, and a resilient pinch roller 28. The driving roller 26 and the pinch roller 28 are positioned so that a nip (interface) is formed along a line 30.

The pinch roller 28 is held against the driving roller 26 with a conventional spring bias (not shown). A receiver 32 is moved laterally past the print head 22 as the driving roller 26 is rotated by the motor 24. The driving roller 26 moves the receiver 32 because of frictional forces that are transmitted to a surface of the receiver 32 from a surface of the driving roller 26. The frictional force is produced by the pressure of the pinch roller acting against the receiver 32.

A dye donor film 34 is positioned between the print head 22 and the receiver 32. As the receiver 32 and the dye-donor film 34 pass between the print head 22 and the print platen 23, an image is produced on the receiver in a well known manner.

The dye-donor film 34 is a continuous strip of material with patches of dye coated thereon. In the case illustrated in FIG. 1, there is a patch 36 of magenta dye, a partial patch of cyan dye 38 and a partial patch of yellow dye 40.

In operation, the prior art printer 20 repeatedly advances and withdraws the receiver past the print head 22 as separate images of cyan, magenta, yellow and black are successively produced on the receiver 32. In the prior art printer 20, these separate images are not always in precise registration with one another. It has been found that a failure to achieve precise registration of the images is a result of the configuration of the pinch roller 28 relative to the driving roller 26 and the receiver 32.

Figure 2:
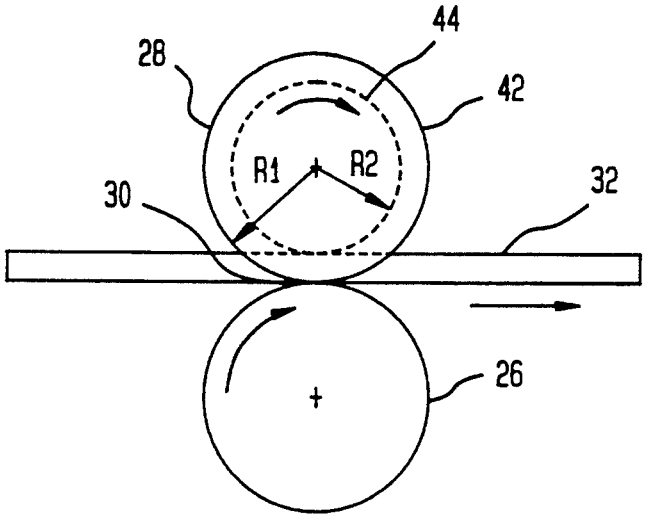
FIG. 2 (PRIOR ART)
FIG. 2 is a partial sectional view of the prior art thermal printer of FIG. 1 taken along the dashed lines 2—2 of FIG. 1.

Referring now to FIG. 2, there is shown a partial sectional view of the prior art printer 20 of FIG. 1 taken along the dashed lines 2—2 of FIG. 1. FIG. 2 shows only the nip 30, the driving roller 26, the pinch roller 28 and the receiver 32 of FIG. 1. The pinch roller 28 is shown with two effective operating surfaces 42 and 44. Because the pinch roller is resilient, the receiver 32 presses into the outer operating surface 42 of the pinch roller 28. When the receiver presses into the operating surface 42, a second inner operating surface 44 is produced. In FIG. 2 these inner and outer operating surfaces 44 and 42, respectively, are shown as being on surfaces of two cylinders having different diameters. The surface 42 is shown as a surface of a cylinder with a radius R1. The surface 44 is shown as a surface of a cylinder having a radius R2.

In FIG. 2, the receiver 32 is shown with an exaggerated thickness for purposes of clarity. In an actual embodiment of the printer 20 of FIG. 1, the receiver 32 is typically 0.010 inches or less in thickness.

It can be seen that when the driving roller 26 is rotated to produce a surface speed of S, then the surface 42 moves with a corresponding surface speed S. Similarly, the receiver 32 is driven with a surface speed S. But, there must be some differential speed between the surface speed of the receiver 32 and the surface speed of the operating surface 44 in order for the receiver 32 to move with a surface speed S. When the operating surface 42 moves with a surface speed of S, it is impossible for the operating surface 44 to move with that same surface speed. The two operating surfaces 42 and 44 each rotate about the same axis at the same angular velocity. Consequently, the surface speed of the operating surface 44 is always less than the surface speed of the operating surface 42.

This speed differential produces shear forces in the receiver 32. These shear forces produce slippage of the receiver 32 relative to the driving roller 26. The slippage occurs whenever a buildup of shear forces exceeds the frictional holding forces developed between the receiver 32 and the driving roller 26. This slippage phenomenon occurs on a substantially random basis. Thus it is virtually impossible to predict with precision the position of the receiver 32 relative to the nip 30 at any given moment.

Even when a receiver has a thickness as small as 0.002 inches, the differential between R1 and R2 is great enough to produce printing artifacts in a printer that is designed for use in an office setting.

When a printer is designed for an office application, there are practical limits on the overall size of the printer. In other words, it is not practical to build an office-use thermal printer which is larger than a cube having twenty four inch sides. Such an overall size limitation produces a size limitation for the components of the printer. The pinch roller 28 for example, cannot be sixty inches in diameter and still fit within a cube having twenty four inch sides. Indeed, it has been found that the pinch roller must have a diameter less than about three inches in order fit into the space that is left after all other components of the printer are assembled into the twenty four inch cube.

With the pinch roller 28 at three inches or less in diameter, the difference between R1 and R2 is substantial when the receiver is 0.002 inches or more in thickness. At these dimensional ratios, the surface speed of operating surface 42 is approximately 0.2% greater than the surface speed of the operating surface 44.

It has been found that surface speed differentials greater than about 0.1% produce image artifacts in full color images. The image artifacts are particularly noticeable as "halo effects" when black text is included in the image.

Figure 3:
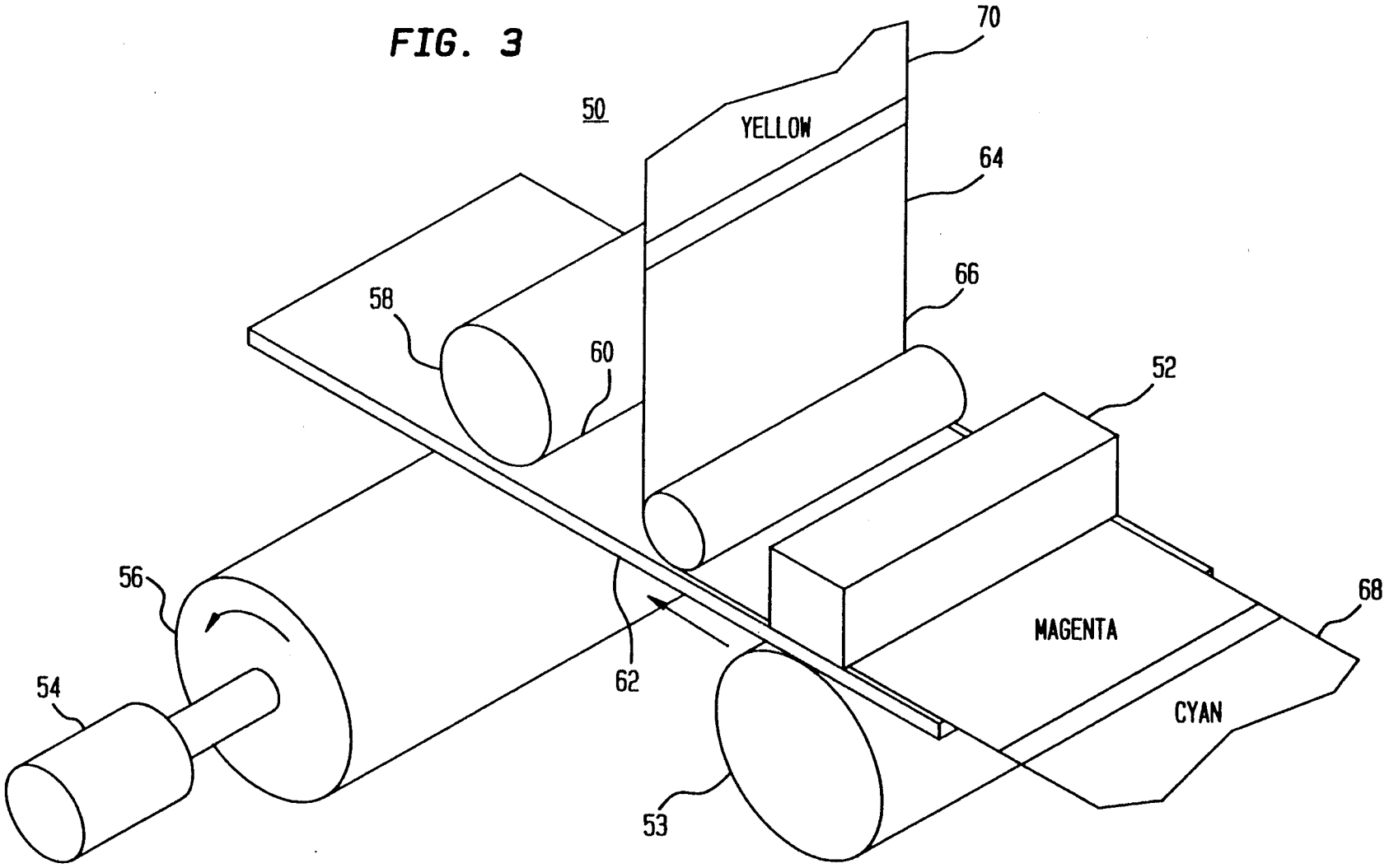
FIG. 3 is a perspective schematic view of a thermal printer in accordance with the present invention.

Referring now to FIG. 3, there is shown a thermal printer 50 in accordance with the present invention. The printer 50 comprises a print head 52, a print platen 53, a drive motor 54,.a driving roller 56, and a resilient pinch roller 58. The driving roller 56 and the pinch roller 58 are positioned so that a nip (interface) is formed along a line 60.

A receiver 62 is moved laterally past the print head 52 as the driving roller 56 is rotated by the motor 54. A dye donor film 64 is positioned between the print head 52 and the receiver 62. As the receiver 62 and the dye-donor film 64 pass between the print platen 53 and the print head 52, an image is produced on the receiver in a well known manner.

The dye-donor film 64 is a continuous strip of material with patches of dye coated thereon. In the case illustrated in FIG. 3, there is a patch 66 of magenta dye, a partial patch of cyan dye 68 and a partial patch of yellow dye 70.

In operation, the printer 50 repeatedly advances and withdraws the receiver 32 past the print head 52 as separate image of cyan, magenta, yellow and black are successively produced on the receiver 62. In the inventive printer 50, these separate images are produced in precise registration with one another.

It has been found that an improved capability to achieve precise registration of the images is a result of the configuration of the pinch roller 58 relative to the driving roller 56 and the receiver 62. The pinch roller 58 does not contact the driving roller 56 when the receiver 62 is in position between the rollers 56 and 58. Consequently, the pinch roller 58 has a surface speed that is imparted to it exclusively by the receiver 62. The pinch roller 58 rotates freely and is not influenced by the receiver 62. Accordingly, the driving roller 56 does not introduce a shear force on the receiver 62. Thus the receiver 62 is moved by the driving roller 56 in a very predictable manner.

There is no differential between the surface speed of the pinch roller 58 and the receiver 62. Consequently, the printer 50 can be made compact in size. The pinch roller 58 can be made with a circumference substantially smaller than a length of the receiver 62. Pinch rollers that are three inches or less in diameter are quite practical within the scope of the present invention.

Although it is possible to build compact printers with the pinch rollers 58 as large as three inches in diameter, it is desirable to make the pinch rollers substantially smaller than three inches in diameter. The desirability of the smaller size is related to the fact that the printer 50 is typically employed in the production of graphical images. When a graphical image is placed on the receiver 62, it is desirable to make borders around the image as small as possible.

In order to produce small borders, it is necessary that the nip 60 be very close to the print head 52. A border around an image must be greater than the distance between the nip 60 and the print head 52. This is because the receiver 62 must remain held within the nip 60 when outer edges of the various color images are printed. This permits the printer 50 to withdraw the receiver 62 to a starting position so that each overlying color image can be successively printed.

If a border of, for example one inch, is desired, the distance between the nip 60 and the print head 52 must be less than one inch. Consequently, in this example, the pinch roller 58 and the driving roller 56 must each have a radius less than one inch.

In FIG. 3, the nip 60 is shown a substantial distance from the print head 52 for purposes of clarity. In an actual embodiment of the printer 50 that is used to make prints with small borders, the pinch roller 58 and the driving roller 56 are substantially adjacent the print head 52. In such an embodiment the driving roller 56 and the pinch roller 58 are about 0.75 inches in diameter, and this permits the production of prints with one inch borders.

A desirable embodiment of the present invention is a thermal printer adapted for office use. In such a context, the thermal printer 50 typically generates images on paper that is about 8.5×11 inches. An office printer capable of producing images 8 inches wide with borders as small as one inch must have a driving roller 56 with a length to diameter ratio of about ten to one. It has been found that when the pinch roller 58 and the driving roller 56 have a high length to diameter ratio, say 4 to 1 or greater, the rollers tend to lose rigidity along their axes. In other words, the rollers tend to deflect or bend. This tendency to deflect produces a condition in which shear forces between the receiver 62 and the pinch roller 56 would be particularly troublesome. Shear forces are substantially reduced by use of the thermal printer 50 of the present invention and thus rollers with a length to diameter ratio greater than about 4 to 1, and typically about 10 to 1, are readily usable in color thermal printers to generate wide images with narrow image-free borders. In a typical embodiment of the thermal printer 50, the driving roller 56 and the pinch roller 58 each have a length to diameter ratio of about 10.

Because shear forces are substantially reduced, the thermal printer 50 can be used to produce images on receivers which are thicker than 0.002 inches. There is no need to be concerned with increased differential surface speeds that develops in the prior art printer 20 of FIG. 1 when thick receivers are driven. Indeed it is possible to print high resolution images on receivers that are 0.010 inches thick or greater.

Figure 4:
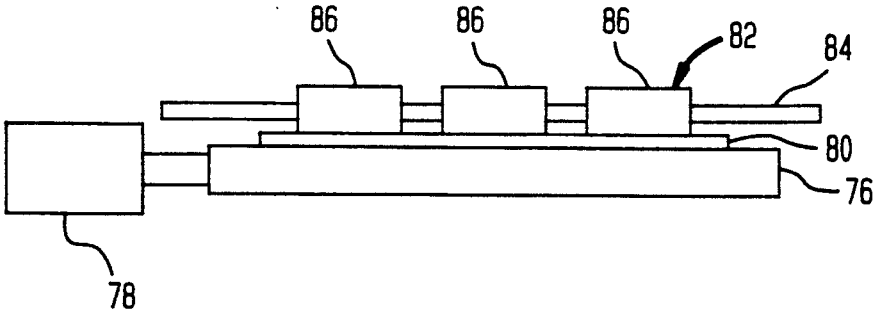
FIG. 4 is a schematic view of an adjustable pinch roller that is useful on thermal printers operated in accordance with the present invention.

Referring now to FIG. 4, there is shown another embodiment of a pinch roller assembly 82 in accordance with the present invention and useful in a thermal printer. FIG. 4 is a partial schematic view of a thermal printer comprising a driving roller 76, a motor 78, a receiver 80, and the pinch roller assembly 82. The pinch roller assembly 82, which can be substituted for the pinch roller 58 of FIG. 3, comprises a shaft 84 and a plurality of rollers 86. Each of the rollers 86 is adapted to rotate with the shaft 84. The rollers 86 are provided with conventional releasable locking screws (not shown) which are used to hold each of the rollers at a desired location on the shaft 84. The roller assembly 82 is adaptable to a range of widths of the receivers 80. For example, if there is a desire to print an image on a receiver that is narrower than the one shown in FIG. 4, the rollers 86 are brought closer together on the shaft 84. This is done simply by releasing the locking screws in each of the rollers 86 and moving the rollers axially along the shaft 84 to new positions. Similarly, an image can be produced on a wider receiver by moving the rollers 86 to a wider spacing on the shaft 84 or by adding additional rollers 86 to the roller assembly 82.

It is to be appreciated and understood that the specific embodiments of the invention are merely illustrative of the general principles of the invention. Various modifications may be made by those skilled in the art which are consistent with the principles set forth. For example, the present invention is useful in any type of printer in which overlying images are formed with successive repeating passes of a receiver relative to a print head.

What is claimed is:

1. A thermal printer for printing an image on a receiver comprising:

a thermal printing head;

a driving roller for driving the receiver relative to the thermal printing head;

a pinch roller adapted to exert force against the driving roller along a nip;

the pinch roller having an axis and a length along said axis that is no longer than a width of the receiver being driven by the driving roller; and the pinch roller having a length to diameter ratio of about four or greater.

2. The thermal printer of claim 1 wherein the pinch roller has a length to diameter ratio of about ten or greater.

3. The thermal printer of claim 1 wherein the pinch roller has a diameter less than about one inch.

4. A thermal printer for printing an image on a receiver comprising:

a thermal printing head;

a driving roller for advancing and withdrawing the receiver relative to the thermal printing head to facilitate production of a color image on the receiver;

a pinch roller adapted to exert force against the driving roller along a nip;

the pinch roller having an axis and a length along the axis thereof that is less than a width of the receiver being driven by the driving roller so that shear forces between the receiver and the pinch roller as reduced and the color image is produced with improved color definition; and the pinch roller having a diameter such that said length along the axis is greater than about four times the diameter of said pinch roller so that the thermal printer is provided with a capability of producing images with relatively narrow image-free borders on relatively wide receivers.

5. A thermal printer for printing a color image on a receiver with an image-free border having a certain desired width, the printer comprising:

a thermal printing head;

a driving roller for advancing and withdrawing the receiver relative to the thermal printing head to facilitate production of a color image on the receiver;

a pinch roller adapted to exert force against the driving roller along a nip;

the pinch roller having an axis and a length along said axis that is no longer than a width of the receiver being driven by the driving roller;

the pinch roller and the driving roller having respective diameters such that the respective lengths of the pinch roller and of the driving roller along their respective axes are greater than about four times said respective diameters; and the pinch roller and the driving roller being located so that respective axes of the pinch roller and of the driving roller are closer to the printhead than the desired width of the image-free border.

6. The thermal printer of claim 5 wherein the pinch roller and the driving roller each having respective diameters such that the respective lengths of the pinch roller and of the driving roller along their respective axes are greater than about ten times said respective diameters.

7. A method of printing a color image on a receiver with image-free borders having a certain desired width, the method comprising the steps of:

driving the receiver past a printing head while producing a first color image thereon;

withdrawing the receiver from the printing head;

driving the receiver past the printing head while producing a second color image thereon;

the driving and withdrawing steps being performed by rotating a driving roller that is frictionally engaged with the receiver; and maintaining a frictional force between the receiver and the driving roller with a pinch roller that contacts the receiver but does not contact the driving roller, the driving roller and the pinch roller each having a diameter and a length such that the respective lengths of the pinch roller and of the driving roller are greater than about four times the respective diameters of the pinch roller and of the driving roller so that said image-free borders of the desired size are generated.

* * * * *